United States Patent [19]

Cook

[11] Patent Number: 4,473,324

[45] Date of Patent: Sep. 25, 1984

[54] MINE ROOF SUPPORTS

[75] Inventor: Stephen P. Cook, Gloucester, England

[73] Assignee: Dowty Mining Equipment Limited, England

[21] Appl. No.: 469,011

[22] Filed: Feb. 23, 1983

[30] Foreign Application Priority Data

Mar. 6, 1982 [GB] United Kingdom ..... 8206677

[51] Int. Cl.[3] ..... E21D 23/12

[52] U.S. Cl. ..... 405/302; 405/291; 91/170 MP

[58] Field of Search ..... 405/291–302; 91/170 MP

[56] References Cited

U.S. PATENT DOCUMENTS

| | | | |
|---|---|---|---|
| 4,226,558 | 10/1980 | Bower et al. | 405/302 |
| 4,264,237 | 4/1981 | Irresberger et al. | 405/302 |

FOREIGN PATENT DOCUMENTS

| | | | |
|---|---|---|---|
| 1279582 | 10/1968 | Fed. Rep. of Germany | 405/302 |
| 1514475 | 1/1968 | France | 405/302 |
| 1098628 | 1/1968 | United Kingdom | 405/302 |
| 1179758 | 1/1970 | United Kingdom | 405/302 |
| 2042035 | 9/1980 | United Kingdom | 405/302 |

*Primary Examiner*—Dennis L. Taylor

*Attorney, Agent, or Firm*—Hayes, Davis & Soloway

[57] ABSTRACT

A mine roof support includes a first liquid supply means having a first control valve for connecting a source of liquid under pressure to the legs of the support. The support is also provided with a second control valve which is actuatable, when the pressure of the liquid being supplied to the legs attains a value below the setting pressure for the legs, to connect the legs to a source of liquid under pressure by way of a second liquid supply means. Time-delay means is operable on the second control valve to cause it to close when a predetermined time has elapsed after the pressure in the legs has reached the setting pressure.

4 Claims, 4 Drawing Figures

MINE ROOF SUPPORTS

Figure 1:
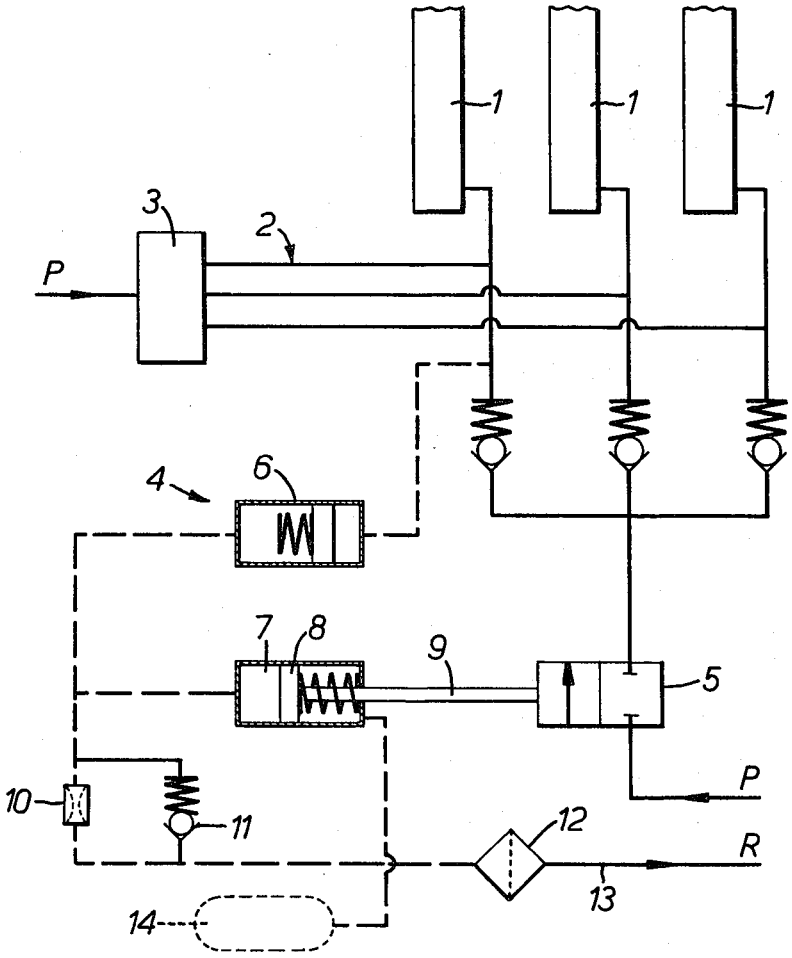

This invention relates to mine roof supports.

A mine roof support includes a plurality of hydraulically-operated props or legs which can be extended to urge an upper part or parts of the support against the roof of a mine, in order to support that roof. To extend the legs, liquid at pressure is supplied from a pump, by way of a valve or valves, to the legs. It is necessary for a mine roof support to be urged against a roof by a predetermined force and hence by a predetermined pressure (usually referred to as "the setting pressure") in the legs. A mine roof support is usually provided with a means for ensuring that the setting pressure is reached even if a relevant control valve, controlling the supply of liquid to the leg(s), is closed by accident or otherwise before the setting pressure in the leg(s) is attained.

To that end, a second valve—a pressure-responsive valve—has been provided which responds to a pressure in the legs, relatively low in comparison with the required setting pressure. When the second valve responds to the relatively-low pressure, it opens to connect a second flow line from the pump to the legs, which flow line by-passes the first, or control, valve. Once the roof support has been set against a roof with the required setting pressure in the legs, the second valve remains open. Thus each of the legs of the roof support is constantly exposed to the setting pressure.

This is not advantageous, for if the roof being supported by the legs crumbles, the roof may be further damaged because of the constant high forces which are being applied to the roof by the constantly-pressurised legs.

To overcome that disadvantage, a third valve—also a pressure-responsive valve—has been provided. This third valve responds to the setting pressure in the legs to remove, from the second valve, that pressure in the legs to which that second valve responded, and that second valve closes to cut off the legs from the pump.

The resulting hydraulic circuit is a complicated one and, because the third valve is a pressure-responsive valve, there is the risk that it may respond to cause closure of the second valve before the setting pressure has been attained in the legs.

It is an object of this invention to provide an improved mine roof support.

According to the invention, a mine roof support includes (i) a first liquid supply means having a first control valve for connecting a first source of liquid under pressure to the legs, (ii) a second liquid supply means having a second control valve for connecting a second source of liquid under pressure to the legs, (iii) the second control valve being actuatable when the pressure of the liquid being supplied to the legs by the first supply means attains a value below the setting pressure, to connect the legs to the second source of liquid under pressure by way of the second liquid supply means, and (iv) time-delay means operable on the second control valve to cause it to close when a predetermined time has elapsed after the pressure in the legs has reached the setting pressure.

The first source of liquid under pressure and the second source of liquid under pressure may be one and the same source.

The time-delay means may be a mechanical means, an electrical means or a hydraulic means. One example of a hydraulic means is a liquid-flow restrictor.

The second control valve may be actuated by a free-piston device which causes liquid to be displaced to cause opening of the second control valve.

The legs of a mine roof support in accordance with the invention always attain the setting pressure before the legs are cut off from the source supplying the liquid.

Figure 2:
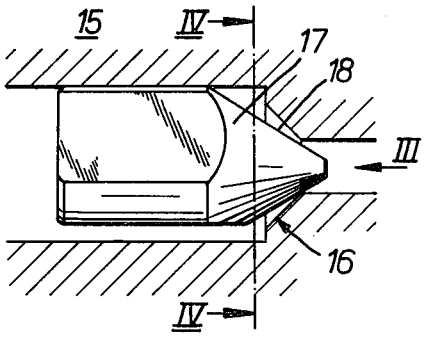
Figure 3:
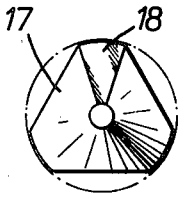
Figure 4:
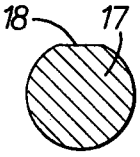

One embodiment of the invention, given by way of example, is illustrated in the accompanying drawings of which FIG. 1 is the hydraulic circuit for setting the legs of a mine roof support against a roof, FIG. 2 is a view of part of a combined restrictor-and-check-valve, suitable for use in the hydraulic circuit, FIG. 3 is an end view of the valve-closure member looking in the direction III shown in FIG. 2, and FIG. 4 is a sectional view of the valve-closure member taken along the line IV-IV of FIG. 2.

Referring to the drawings, the mine roof support has three legs 1 which are connected by a first liquid supply means 2, having a manually-operable control valve 3, to a source of pressurised liquid P.

The legs can also be connected to that source P (or, to a second source which can be at the same pressure as the source associated with the first liquid supply means or at a higher pressure) by a second liquid supply means 4, having a control valve 5.

The legs are further connected to a free-piston device comprising a master cylinder 6 and a slave cylinder 7. The piston 8 in the slave cylinder 7 is connected by a piston rod 9 to the valve 5.

The master cylinder 6 and the slave cylinder 7 are connected by way of a restrictor 10 and a check valve 11 to a filter 12 and a return low-pressure line 13.

In operation, when it is necessary to set the roof support against a roof, the manually-operable control valve 3 will be opened, and liquid will flow from the source of liquid under pressure, P, to the legs 1, causing them to extend.

When a certain pressure has been attained in the legs 1, which pressure is lower than the setting pressure, the force of the spring acting on the piston in the master cylinder 6 will be overcome and the piston will move to the left, as seen in FIG. 1, until it comes to a standstill against or near to the end of the cylinder with the spring completely compressed. As the piston moves to the left, it will displace liquid, and the displaced liquid will cause the piston 8 in the slave cylinder 7 to move to the right, as seen in FIG. 1, until it has opened valve 5. The legs are now connected to the source of liquid under pressure P not only by way of the first liquid supply means but also by way of the second liquid supply means. Thus, if the manually-operable control valve 3 is closed before the setting pressure in the legs has been attained, the legs will still be connected to the source of liquid under pressure P.

Once the valve 5 has been opened, the displaced liquid in the slave cylinder 7 will begin very slowly to leak away to the return line by way of the restrictor 10. Eventually the spring in the slave cylinder will move the piston 8 sufficiently to the left, as seen in FIG. 1, causing the valve 5 to close. The size of the restrictor 10 is chosen to ensure that the valve 5 does not move from its open position to its fully closed position until a certain time has elapsed after the pressure in the legs has reached the setting pressure.

When eventually the roof support no longer needs to support a roof, and is to be advanced to a new position in which it will support another region of the roof, the legs will be caused to contract, and the pressure inside them will fall below that value which caused movement of the piston in the master cylinder. When that occurs, the spring in the master cylinder will move the piston to the right and the master cylinder will be charged with liquid by way of the check valve, which will open.

Instead of connecting the restrictor and the check valve to a filter 12 and a low-pressure line 13, they may be connected to an accumulator 14.

FIG. 2 of the drawings shows a part of a combined restrictor-and-check-valve suitable for use with the invention. The check valve comprises a body member 15, a valve-seat 16 formed in the body member and a valve-closure member 17 arranged to seat on the valve seat. The surface of the valve-closure member 17 is provided with a flat 18 which acts with the body member to provide a small clearance over a part of the periphery, which clearance acts as a restrictor.

As the master cylinder is charged with liquid by way of such a check valve, any dirt in the restrictor will be flushed away from the restrictor, to prevent any silting of the restrictor, which silting could, eventually, impair the operation of the restrictor.

I claim:

1. A mine roof support comprising (a) hydraulically-operated leg means operable, when supplied with liquid under pressure, to force a roof-engageable member into engagement with the roof of a mine with a predetermined setting pressure, (b) a first liquid-supply means for the leg means having a first control valve, whereby, when the valve is open, the leg means is connectible to a first source of liquid under pressure, (c) a second liquid-supply means for the leg means having a second control valve, whereby, when the valve is open, the leg means is connectible to a second source of liquid under pressure, (d) actuating means responsive to the pressure of the liquid in the first liquid-supply means and arranged to open the second control valve when the pressure of the liquid in the first liquid-supply means attains a predetermined value which is lower than said predetermined setting pressure, and, (e) time-delay means operable on the second control valve to cause it to close when a predetermined time has elapsed after the pressure in the leg means has reached the said predetermined setting pressure.

2. A mine roof support as claimed in claim 1 in which the first liquid-supply means and the second liquid-supply means are arranged for connection to one and the same source of liquid under pressure.

3. A mine roof support as claimed in claim 1 in which the time-delay means is a liquid-flow restrictor.

4. A mine roof support as claimed in claim 3 in which the actuating means includes a free-piston liquid-displacing device.

* * * * *